US007496421B2

(12) United States Patent
Mühlenmeister et al.

(10) Patent No.: US 7,496,421 B2
(45) Date of Patent: Feb. 24, 2009

(54) METHOD AND APPARATUS FOR ORDER CONTROL IN A PRODUCTION PROCESS FOR A FIBER PRODUCT

(75) Inventors: Reinhard Mühlenmeister, Köln (DE); Jörg Gross, Remscheid (DE); Dirk Seulen, Sprockhövel (DE)

(73) Assignee: Saurer GmbH & Co. KG, Mónchengladbach (DE)

( * ) Notice: Subject to any disclaimer, the term of this patent is extended or adjusted under 35 U.S.C. 154(b) by 29 days.

(21) Appl. No.: 11/446,639

(22) Filed: Jun. 5, 2006

(65) Prior Publication Data

US 2007/0027565 A1 Feb. 1, 2007

Related U.S. Application Data

(63) Continuation of application No. PCT/EP2004/013420, filed on Nov. 26, 2004.

(30) Foreign Application Priority Data

Dec. 5, 2003 (DE) ..... 103 57 003

(51) Int. Cl.
*G06F 19/00* (2006.01)
*D21F 7/00* (2006.01)

(52) U.S. Cl. ..... 700/109; 162/263

(58) Field of Classification Search ..... 700/28–30, 700/95, 108–110, 117, 122–130; 162/49, 162/252, 263
See application file for complete search history.

(56) References Cited

U.S. PATENT DOCUMENTS 3,622,448 A * 11/1971 Adams et al. ..... 162/198
3,648,035 A * 3/1972 Hart et al. ..... 700/34
3,847,579 A 11/1974 Fulk et al.
3,936,665 A * 2/1976 Donoghue ..... 700/129
4,453,404 A * 6/1984 Powell et al. ..... 73/159
4,819,176 A * 4/1989 Ahmed et al. ..... 700/109
4,953,367 A 9/1990 Memminger et al.
5,893,055 A * 4/1999 Chen ..... 702/189
6,092,003 A * 7/2000 Hagart-Alexander et al. ..... 700/129
6,447,639 B1 * 9/2002 Warren et al. ..... 162/49
7,035,877 B2 * 4/2006 Markham et al. ..... 707/200
7,194,318 B2 * 3/2007 Attarwala ..... 700/29
7,204,914 B2 * 4/2007 Lampela ..... 162/238
2003/0149493 A1 * 8/2003 Blevins et al. ..... 700/18
2005/0016704 A1 * 1/2005 Huhtelin ..... 162/198
2005/0263259 A1 * 12/2005 Sidhu et al. ..... 162/23

(Continued)

FOREIGN PATENT DOCUMENTS

DE 199 11 704 A1 10/1999

(Continued)

*Primary Examiner*—M. N. Von Buhr
(74) *Attorney, Agent, or Firm*—Alston & Bird LLP

(57) ABSTRACT

The invention relates to a method and an apparatus for order control in a production process for a fiber product. In this case, at least one primary product is provided and processed further to form the fiber product, the processing steps of the further processing being performed by machines, the production process being monitored and controlled. According to the invention, in order to control and monitor a production order constituting the basis of the production process, an actual/target evaluation is performed between a target standard predefined by the production order and an actual status of the production process. The deviation from the target standard determined thereby is displayed.

18 Claims, 4 Drawing Sheets

U.S. PATENT DOCUMENTS

2007/0158040 A1* 7/2007 Benaoudia et al. ..... 162/49

FOREIGN PATENT DOCUMENTS

DE 102 50 442 A1 5/2003
EP 0 580 071 B1 11/1999
SU 964 030 A1 10/1982
WO WO 94/25869 11/1994

* cited by examiner

METHOD AND APPARATUS FOR ORDER CONTROL IN A PRODUCTION PROCESS FOR A FIBER PRODUCT

CROSS REFERENCE TO RELATED APPLICATION

The present application is a continuation of International Application No. PCT/EP2004/013420, filed Nov. 26, 2004, and which designates the United States. The disclosure of the referenced application is incorporated herein by reference.

BACKGROUND OF THE INVENTION

The invention relates to a method for order control in a production process for a fiber product, and to an apparatus for executing the method. The production of fiber products is substantially determined by the quality standards that the fiber product is to possess. Irrespective of whether the fiber product is a single fiber or a fabric, certain application-specific properties are required. Thus, for example, U.S. Pat. No. 5,469,149 (EP 0 580 071 A2) describes the production of a synthetic fiber in which the respectively produced quality of the fiber is monitored continuously during the process. In this case, in the event of deviations, a selective method modification can be made in the production process. In this case, the production process is usually monitored and controlled from a plant controller.

In practice, the fiber products that are to be produced are determined by individual production orders. Each production lot of a fiber product is thus based on a production order. In the case of the processing of a plurality of production orders, the problem arises, particularly in the process for the production of fiber products, that, due to the complex processing steps for the production of the fiber product, a multiplicity of parameters results in unavoidable production process malfunctions, due to fluctuating quality of the fiber product or process interruptions. Thus, for example, in the case of a process for the production of textured yarns, in which a fed synthetic yarn is stretched and crimped, the fiber product is divided into quality levels A, B and C. Thus, for example, a production order having as a target standard a certain product quantity of the quality A could only be produced as efficiently as possible if, during the production process, the quality levels B and C are immaterial or do not arise at all. This cannot be realized, however, since a spool containing the crimped yarn is already assessed as being of B quality if, for example, there is contained within the spool a thread knot resulting from the transition from a supply spool to a reserve spool. Consequently, planning for the purpose of processing a plurality of successive production orders is scarcely possible, or is possible only with great effort.

Accordingly, an object of the invention is to create both a method for order control in a production process for a fiber product, and an apparatus for executing the method, with which planning for the purpose of executing production orders is possible.

A further aim of the invention is to monitor the production process in respect of the underlying production order.

BRIEF SUMMARY OF THE PRESENT INVENTION

The present invention achieves the above objectives and others by providing a method and apparatus for order control in a production process for a fiber product.

In one embodiment, the present invention provides a method that comprises providing and further processing at least one primary product to form the fiber product, performing individual processing steps of the further processing by machines, determining the course of the production process by a target standard of a production order, recording an actual status of the production process, performing an actual/target evaluation between a target standard predefined by the production order and the actual status of the production process, and displaying a deviation from the target standard. In another embodiment, the actual status of the production process is determined by a partial quantity of fiber product finished per unit of time, and an order-related actual value relating to the fiber product is calculated from the partial quantity of fiber product and a differential value is produced from the actual/target evaluation, wherein at least one of a product quantity or a production time for the predefined production order is determined by the target standard. In yet another embodiment, the actual value is calculated from unit of time, the partial quantity of fiber product and the product quantity, wherein an actual/target comparison results in a production time difference as a differential value. In yet another embodiment, the actual value is calculated from the partial quantity of fiber product, the unit of time and the production time, wherein the actual/target comparison results in a product quantity difference as a differential value. In yet another embodiment, the order-related target standard is entered manually via at least one of an operating unit or an ERP control unit. In yet another embodiment, the differential value is displayed by at least one of a display on the operating unit or a tracking system on the ERP control unit. In yet another embodiment, a counter-check is compiled between the target standard and the differential value in relation to a plurality of subsequent production orders, and a processing plan is derived from the counter-check. In yet another embodiment, in a case of non-fulfillment of the target standard, the target standard is modified, and a new processing plan is compiled from a renewed actual/target evaluation. In yet another embodiment, one or more status variables are recorded in relation to the fiber product or the machines executing the processing steps, and the partial quantity of fiber product is determined by means of the status variables. In yet another embodiment, a plurality of target standards of a plurality of production orders are defined, the target standards and the actual value are counter-checked according to a planning algorithm, and the provision of primary products for the subsequent orders is initiated in dependence on the counter-checking. In yet another embodiment, the target standard is complemented by specifications relating to product properties and product qualities.

Another embodiment of the present invention provides an apparatus that comprises a production plant for a fiber product produced from at least one primary product, consisting of a plurality of machines, and having a plant control unit which is connected to the machines via a control and monitoring network, wherein a master planning control unit is provided for performing an actual/target evaluation between a target standard predefined by a production order and an actual status of the production process, the planning control unit being coupled to the plant control unit via a data connection. In yet another embodiment, the plant control unit has a means by which a partial quantity of fiber product finished per unit of time can be determined. In yet another embodiment, the planning control unit has an interface for the connection of at least one of a manual operating unit or an ERP control unit, through which the target standard of the production order can be placed. In yet another embodiment, the master planning control unit has a means for generating a differential value which results from the actual/target evaluation between the target standard predefined by the production order and the actual status of the production process. In yet another embodiment, the master planning control unit has further means for determining a processing plan with specifications for the provision of the primary product and a time sequence for the further processing. In yet another embodiment, the planning control unit is connected to an output unit for visual display of data or processing plans. In yet another embodiment, the output unit is combined with at least one of the operating unit or the ERP control unit.

The invention is distinguished at least by the fact that an intelligent connection is created between the business processes and the production processes. Thus, as soon as new production orders are placed within the business process, the instantaneous situation in the production process can be included. For this purpose, according to the invention, an actual/target evaluation is performed between the target standard predefined by a production order for the production of a fiber product and the respective actual status of the production process that has been initiated on the basis of the production order. In this case, a deviation from the target standard is displayed, so that both the production order presently in the production process and subsequent production orders can be adapted.

For the purpose of executing the method according to the invention, the apparatus according to the invention has a master planning control unit, by which the actual/target evaluation can be performed between the target standard predefined by a production order and an actual status of the production process. In this case, the planning control unit is linked to the plant control unit via a data connection, so that the data necessary for determining the actual status are available to the planning control unit. The planning control unit renders possible automated planning in the production of a fiber product. A fiber product may be both individual synthetic fibers or natural fibers and primary products of these fibers, or flat end-products made from these fibers, such as, for example, woven fabric, knitted fabric or braids.

In the case of a particularly advantageous method variant, it is proposed that the actual status of the production process be determined by a partial quantity of fiber product finished per unit of time, and that an order-related actual value relating to the fiber product be calculated from the partial quantity of fiber product and a differential value be produced from the actual/target evaluation, a product quantity and/or a production time for the predefined production order being determined by the target standard. Thus, with the use of few parameters, it is already possible to effect control and planning of the production order at an early point in time. The unit of time taken as a basis for the partial quantity of fiber product could be predefined in coordination with the production time, in hours, days, weeks or months. In this case, as the production process progresses, the respective cumulatively produced partial quantity of fiber product can be determined after each unit of time, and constitute the basis for calculation of the actual value.

For the purpose of executing this method variant, an advantageous development of the apparatus comprises, at least in the plant control unit, a means by which a partial quantity of fiber product finished per unit of time can be determined. This means can advantageously be constituted by a computation module which can perform an evaluation of the continuously recorded status variables transmitted to the plant control unit. In the simplest case, for example, in a melt-spinning process a weight check on the finished wound spools could be recorded as status variables, and added up in the computation module as a partial quantity of fiber product per predefined unit of time.

It is also possible, however, for the planning control unit to have means which determine the required partial quantities of fiber product directly from the status variables and perform an actual-value calculation.

Depending on the target standard, the differential value resulting from the actual/target evaluation may advantageously be indicated as a production time difference or, alternatively, as a product quantity difference. If it is essential that the product quantity predefined by the target standard be achieved in order to fulfil the production order, the actual value is calculated from the time unit, the partial quantity of fiber product and the product quantity. The actual value thus represents an estimated production completion time which, in the actual/target comparison with the predefined production time, results in a production time difference. This determined production time difference must therefore be taken into account in the planning relating to the completion of the production order, and at the start of subsequent production orders.

If it is essential that the production time predefined by the target standard be achieved due to particularly urgent subsequent orders, the differential value could be indicated as a product quantity difference. For this, the actual value is calculated from the partial quantity of fiber product, the unit of time and the production time. The actual value thus represents an estimated product quantity that can be produced during the production time. The actual/target comparison thus results in a product quantity difference on which the production order must be based.

In the case of simple production processes and plants, the order-related target standards can advantageously be entered manually, via an operating unit. In practice, however, ERP (Enterprise Resource Planning) control units are normally used for controlling the business processes. It is thus particularly advantageous if the target standards can be directly automated and forwarded at the business process level when a production order is placed. Entering of the order-related target standard by means of the ERP control unit is thus particularly advantageous.

For the purpose of executing the method variant, a preferred development of the apparatus is designed in such a way that the planning control unit has an interface for the connection of a manual operating unit and/or an interface for the connection of an ERP control unit. A counter-check between the calculated actual values and the target standard can thus be performed at any time in the planning control unit.

In order that the deviation from the target standard can be continuously taken into account in a plan, the differential value can be displayed either by a display on the operating unit or, advantageously, by a tracking system on the ERP control unit. In the latter case, the effects on subsequent production orders can thus advantageously be taken into account at the same time, in an automated manner, in the ERP control unit, so that the business processes are updated in each case.

For this, an advantageous development of the apparatus comprises, within the planning control unit, a means for generating a differential value. Assuming that the calculated actual value and the target standard have the same basis, the differential value can already be calculated by means of a simple comparison module. The differential value can then be forwarded to the ERP control unit or to an operating unit via the interfaces of the planning control unit. The differential value could then result in the initiation of a modification of the target standard of the production order then being processed or a modification of the target standard of the subsequent production orders.

Basically, such subsequent production orders can also be entered directly in the planning control unit which, following counter-checking between the target standard and the differential value, generates a processing plan matched to the subsequent orders. Such a processing plan might be entered in the ERP control unit, for example, to allow detailed planning. This advantageously also creates the possibility of countering an unacceptable deviation in the context of the business processes, by modifying the target standard of the production order currently being processed or that of the subsequent production orders. The renewed actual/target evaluation thus results in a new processing plan which can be matched, within the business process level, to master standards.

The development of the apparatus in which the planning control unit comprises a means for determining a processing plan is therefore particularly advantageous for creating proposals for the further processing of the production orders. In particular, it provides for control of the provision of the primary products that are processed in the production process for the fiber product. The inclusion in the business processes of the processing plans generated by the planning control unit permits a high degree of flexibility in respect of the execution and completion of a multiplicity of production orders. In this case, the production process can also be divided into a plurality of sub-processes running independently of one another.

Due to the complex production processes, the fiber product to be produced is affected by a multiplicity of machines and product parameters. Thus, for example, a thread breakage within a high-speed spinning process results in production being interrupted at a spinning head. Since, at the time of the thread breakage, the wound spools do not have the required spool weight or spool diameter, in the determination of the partial quantities of the fiber product these spools might, for example, be considered to be only of C quality. In order that a reference partial quantity of fiber product can nevertheless be determined for the production order, further status variables are required, such as the fiber quality. The method variants in which one or more status variables are recorded in relation to the fiber product and/or the machine executing the processing steps are therefore particularly suitable for permitting the execution of an automated plan in the case of complex production processes. For this, the reference partial quantity of fiber product is determined by means of the status variables.

In order to achieve as full a utilization as possible of the production plant, use is made of the method variant in which, from a plurality of target standards of a plurality of production orders, continuous counter-checking with the calculated actual values is performed and, in this case, the provision of primary products for the subsequent production orders is initiated in dependence on the counterchecking. In this case, particular planning algorithms can be predefined through which, for example, priorities can be set.

BRIEF DESCRIPTION OF THE DRAWINGS

Figure 1:
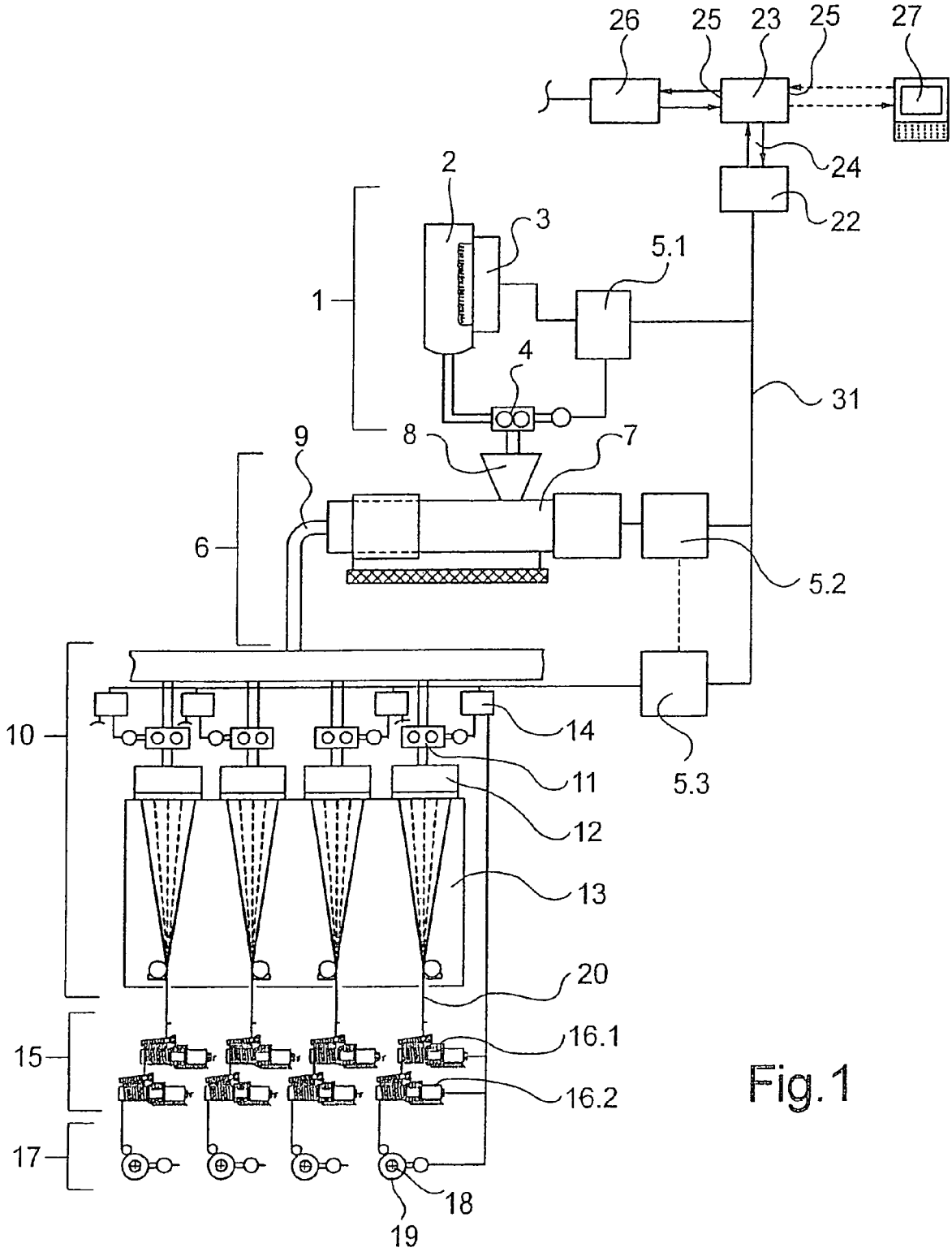
Figure 2:
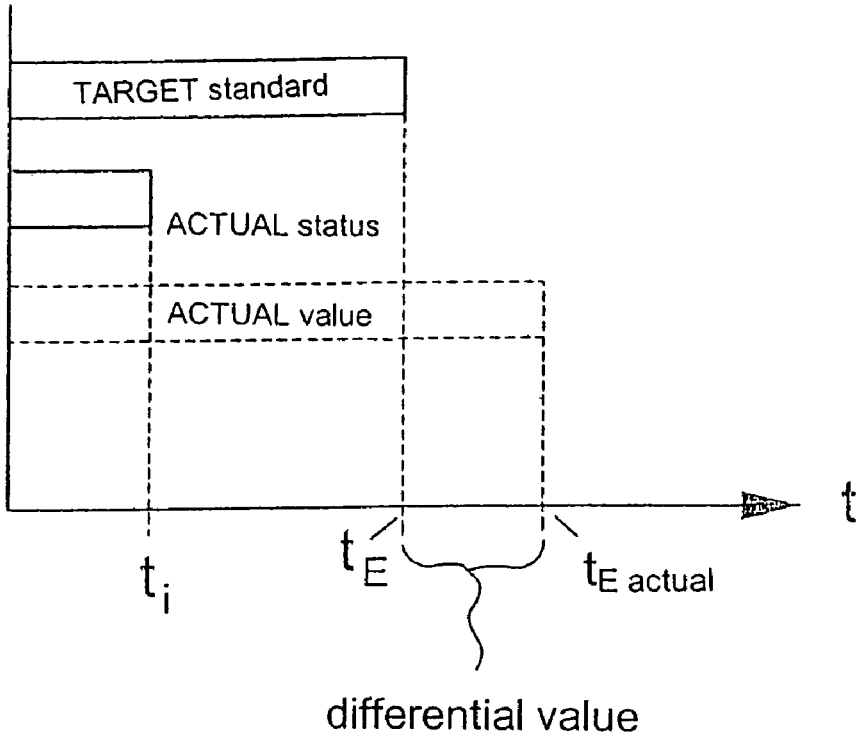
Figure 3:
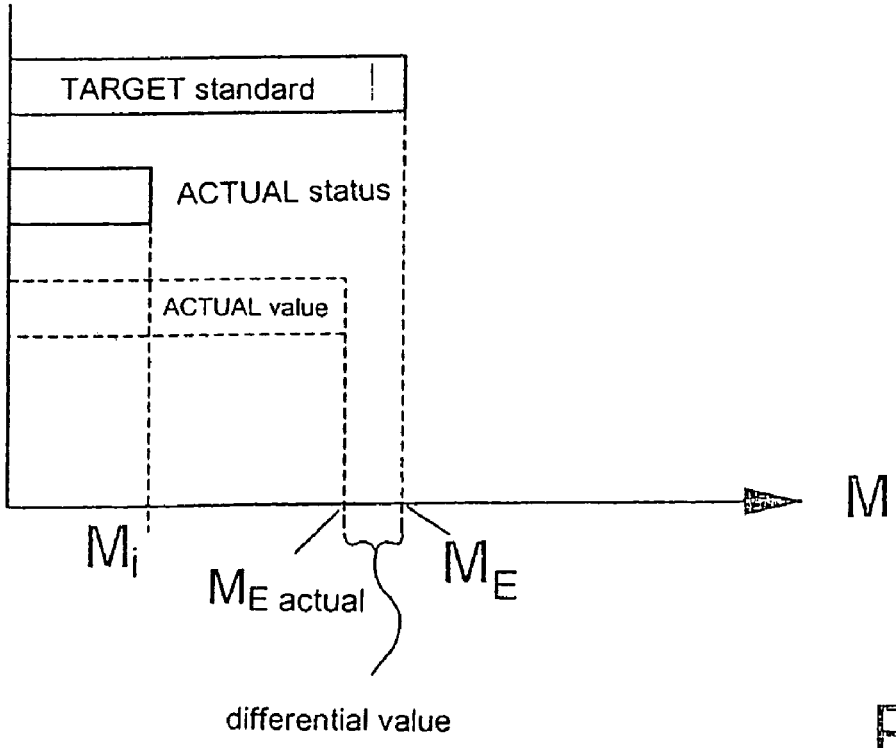
Figure 4:
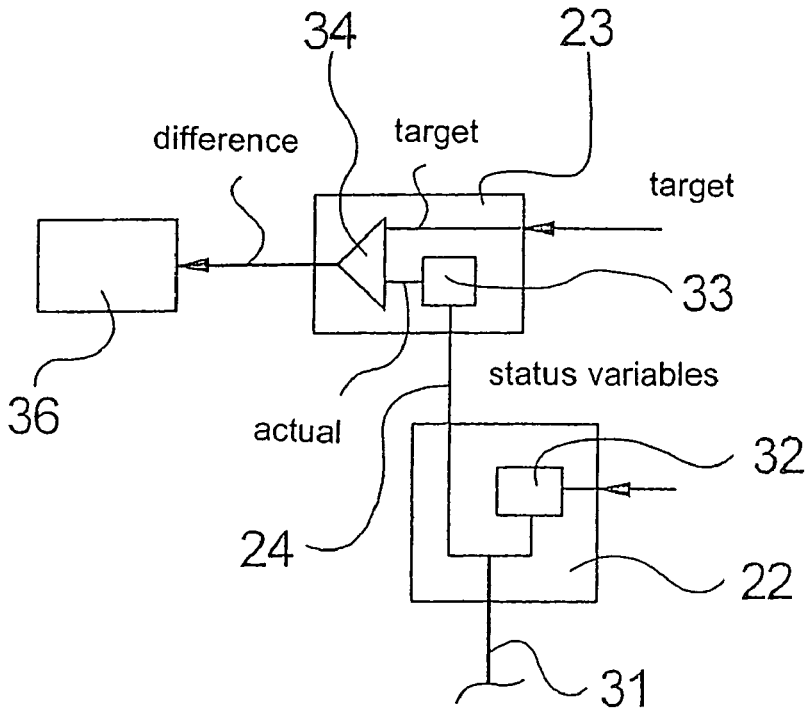
Figure 5:
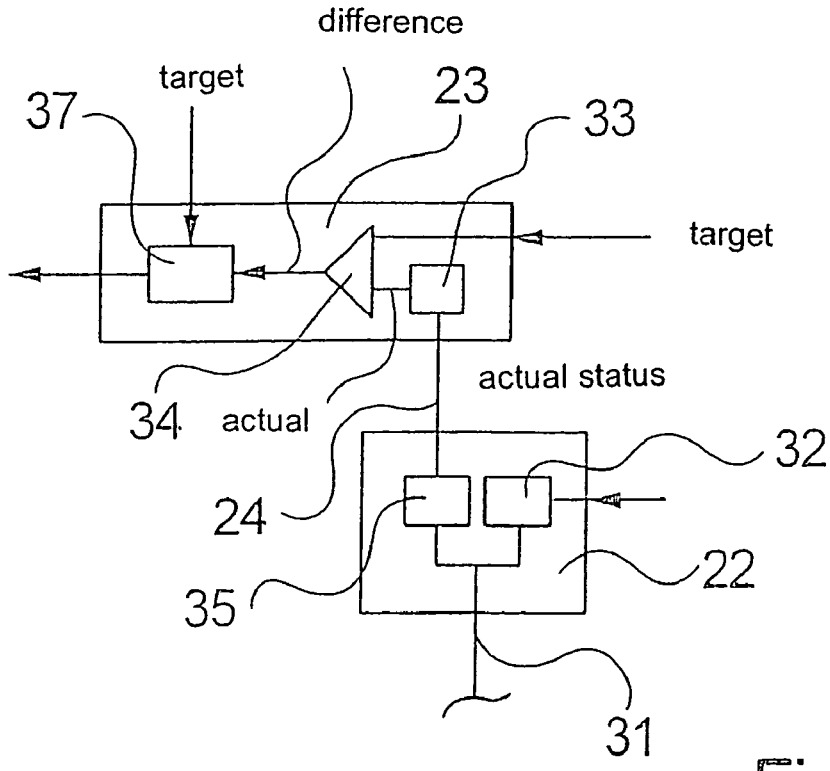
Figure 6:
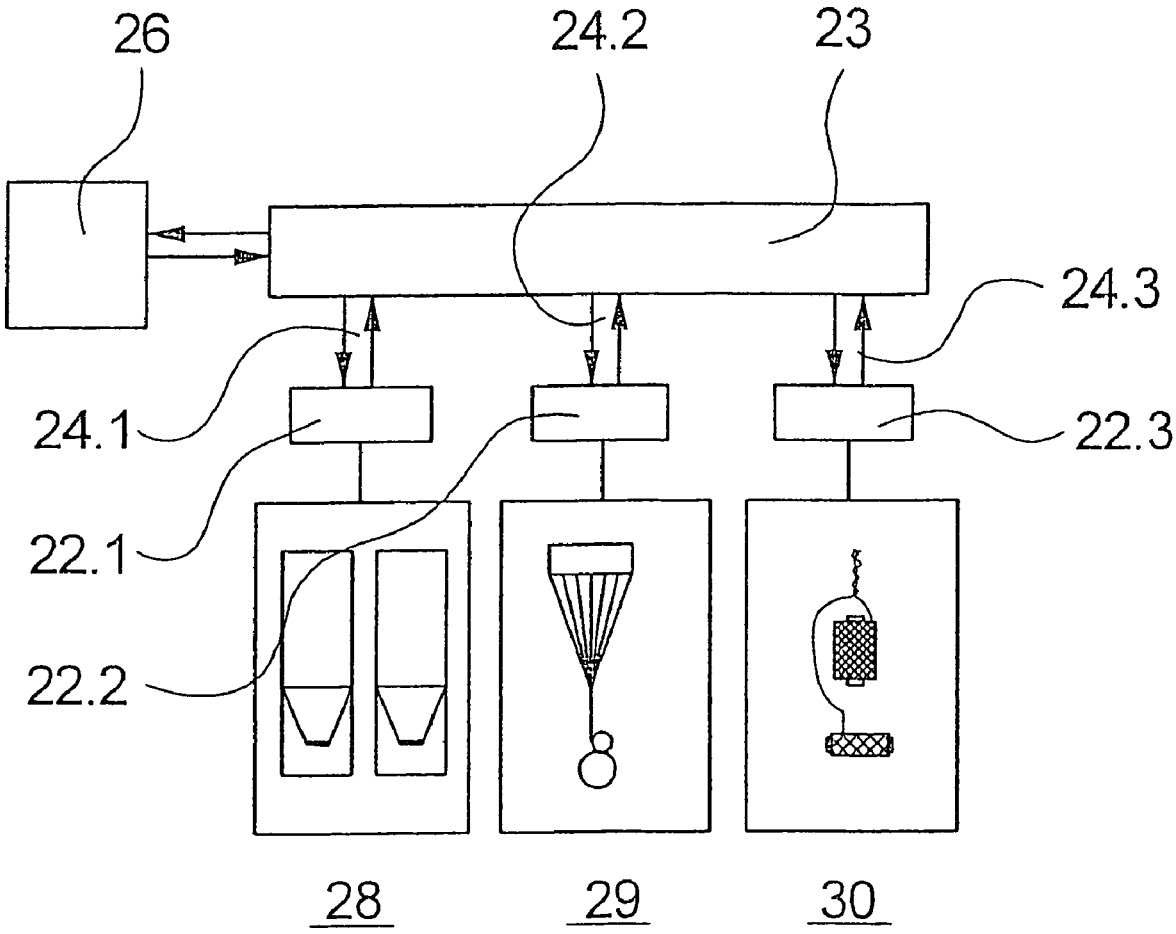

Having thus described the invention in general terms, reference will now be made to the accompanying drawings, which are not necessarily drawn to scale, and wherein:

FIG. 1 shows, in schematic form, a first exemplary embodiment of a production process for a fiber product, with an order control system according to the invention;

FIG. 2 shows, in schematic form, an example for the determination of a differential value for a production order;

FIG. 3 shows, in schematic form, a further example for the determination of a differential value for a production order;

FIG. 4 shows, in schematic form, a signal flow of an exemplary embodiment for the monitoring of a production order;

FIG. 5 shows, in schematic form, a further exemplary embodiment for the monitoring of a production order; and FIG. 6 shows, in schematic form, a multi-stage production process for a fiber product, having an order control system according to the invention.

DETAILED DESCRIPTION OF THE INVENTION

The present invention now will be described more fully hereinafter with reference to the accompanying drawings, in which some, but not all embodiments of the invention are shown. Indeed, the present invention may be embodied in many different forms and should not be construed as limited to the embodiments set forth herein; rather, these embodiments are provided so that this disclosure will satisfy applicable legal requirements. Like numbers refer to like elements throughout.

Both the method for order control according to the invention and the apparatus according to the invention for execution of the method are described more fully in FIG. 1 with reference to an exemplary embodiment of a production process for melt-spun threads.

In the production process, a multiplicity of threads of a thermoplastic material are spun and wound up to form spools. For this, the thermoplastic material is previously conditioned in a granulate preparation system 1. The granulate preparation system 1 comprises, in essence, both a drier 2, having a heating system 3, and a metering system 4. A machine controller 5.1 is provided to control the granulate preparation system 1. The measured dried granulate is supplied to a melt preparation system 6. The melt preparation system 6 consists, in essence, of an extruder 7 to which the granulate is supplied via a filler neck 8. Within the extruder 7 there is a driven extruder screw, so that the granulated is melted and discharged via a melt line 9 at the outlet of the extruder 7. The melt preparation system 6 is monitored and controlled via the machine controller 5.2.

A spinning apparatus 10, a treatment device 15 and a winding device 17 are provided for the melt-spinning, treatment and winding of the threads. The spinning apparatus 10, in detail, comprises a multiplicity of spinning pumps 11 which supply the melt to a multiplicity of spinning heads 12. Each of the spinning heads 12 comprises a multiplicity of spinning nozzles, only one spinning nozzle per spinning head being shown in FIG. 1. The freshly extruded threads are then cooled by a cooling device 13 beneath the spinning head.

In this exemplary embodiment, the treatment apparatus 15 consists of two roller units 16.1 and 16.2, which stretch the threads.

The winding device 17 comprises, for each spinning head, at least one spool spindle 18, on the circumference of which a plurality of spools 19 are formed simultaneously. Each thread 20 is thus wound up to form respectively one spool 19.

For each spinning head, the spinning apparatus 10, the treatment apparatus 15 and the winding device 17 are monitored and controlled by a spinning-head controller 14. In this case, the majority of the spinning-head controllers 14 are coupled to a master machine controller 5.3 via a bus system.

The machine controllers 5.1, 5.2 and 5.3 are connected to a plant control unit 22. The plant control unit 22 is used to control and monitor the entire production process, from the primary product to the fiber end-product. The sensor means used within the granulate preparation system 1, the melt preparation system 6, the spinning apparatus 10, the treatment device 15 and the winding device 17 for monitoring the production process are not illustrated or explained in greater detailed here. DE 199 11 704 A1, for example, describes a process for the production of a synthetic thread from which a system for monitoring the product and machine parameters is known. To this extent, reference is made to the cited publication.

The plant control unit 22 is connected to a master planning control unit 23 via a data connection 24. The planning control unit 23 has an interface 25 through which an ERP control unit 26 is connected to the planning control unit 23. The ERP control unit 26 serves to map business processes for the purpose, for example, of placing and arranging production orders. Standard PPS software systems can be used in this case.

In the case of the exemplary embodiment of a production process represented in FIG. 1, the fiber product being produced is a synthetic thread which is wound on to spools. In this case, the production process is based on a production order which determines, at least, the quantity of thread or spools to be produced. Such production orders are placed, as a business process, in the ERP control unit 26, and thereby initiate the production process. In order that the production order can be monitored and controlled during the processing of the production order, the status variables of the production process supplied to the plant control unit 22 are used in order to determine an actual status of the respective production order in respect of the fiber product to be produced and to supply this to the planning control unit 23. Within the planning control unit 23, an actual value, related to the production order, is extrapolated from the actual status of the production process. The extrapolated actual value constitutes a comparative value in relation to the target standard predefined by the ERP control unit 26. An actual/target evaluation performed between the actual value and the target standard thus results in a differential value which directly demonstrates fulfilment or non-fulfilment of the production order in relation to the predefined target standard. The deviation determined by the planning control unit 23 by means of correspondingly stored algorithms is supplied to the ERP control unit 26. Counter-checking of the business processes, and particularly of the production orders, is thus possible.

The actual status of the production process is usually determined on the basis of a partial quantity of fiber product finished per unit of time, since the target standard of the production order is usually predefined in the form of specifications relating to the product quantity or, alternatively, a production time, or through specification for both the product quantity and the production time. FIG. 2 shows an exemplary embodiment for the formation of a differential value, such as could be executed, for example, in the planning control unit 23 with the use of appropriate means and stored algorithms. In the case of the example in FIG. 2, a time axis is shown, having the reference t. In this case, there is a target standard, which requires a production time $t_E$. Within the production time $t_E$, the quantity of the fiber product to be produced is defined by the target standard. Target standard in this case relates to a production order, and is supplied to the planning control unit. During the production process, at a point in time $t_i$, which is substantially less than the total production time $t_E$, the instantaneous actual status of the production process is determined in respect of the fiber products to be produced. The data contained in the plant control unit 22 are supplied for this purpose to the planning control unit. The time unit in this case is the period of time from the start of the production process to the point in time $t_i$. An extrapolation of the actual value, in relation to the production order, is now performed in the planning control unit using the actual status. Thus, the production partial quantity that has been produced up to the point in time $t_i$ is compared with the total product quantity. The quotient from the product quantity and the product partial quantity multiplied by the unit of time now gives an actual value for the production time. The actual value of the production time is denoted in FIG. 2 by the reference $t_{E\ actual}$. It is evident that, with regard to fulfilment of the production order, the production time $t_E$ cannot be met, but is exceeded by a differential value, in this case a production time difference. The production time difference is supplied to the ERP control unit by the planning control unit, so that a business process optimization, or a modification of the target standard of the production order, or a postponement of subsequent production orders can be effected.

FIG. 3 shows a further exemplary embodiment for the monitoring and control of the production order. In this case, a product quantity axis M is shown. The figure shows the target standards, which are in the form of a maximum product quantity and a production time, the product quantity being denoted by the reference $M_E$. The partial quantity $M_i$ of finished fiber product is determined at a point in time as early as possible during the production process. The actual status of the production process is then extrapolated in the planning control unit to obtain an actual value, in relation to the production order to be executed. For this, the unit of time assigned to the partial quantity of fiber product is compared with the maximum production time. An actual value for the total product quantity is obtained using the quotient from the production time and the unit of time multiplied by the partial quantity of fiber product. In the figure, the actual value of the product quantity is denoted by the reference $M_{E\ actual}$. In this case, a difference is identified between the total product quantity $M_E$ determined by the target standard and the actual value of the product quantity $M_{E\ actual}$. The product quantity difference indicates that, if the maximum production time is observed, the instantaneous actual status of the production process will result in a lesser product quantity. The product quantity difference is supplied to the ERP control unit by the planning control unit.

The exemplary embodiments, represented in FIG. 2 and FIG. 3, for the monitoring of a production order can already be applied to simple production processes in which only the partial quantity of fiber product produced is continuously recorded. Such systems can also be designed as direct systems, without connection to an ERP control unit. In such cases, the planning control unit preferably has an interface for connecting an operating unit. The operating unit 27 is also indicated in FIG. 1. In this case, the connection of the operating unit 27 via a data connection is indicated by broken lines.

Irrespective of the connection to an EPR control unit or an operating unit, the cooperation of the planning control unit with the plant control unit is essential for the monitoring and control of the production orders. For this, FIG. 4 shows a first exemplary embodiment, in schematic form. The plant control unit 22 is connected to the production process machine controllers via a bus connection 31, and to the planning control unit 23 via a data connection 24. The process, product and machine parameters transmitted via the bus connection 31 are divided within the plant control unit 22. On the one hand, the process, product and machine parameters are supplied, within the plant control unit, to a control module 32 through which monitoring and control of the production process can be performed. The other portion of the parameters is forwarded directly to the master planning control unit 23. In the planning control unit 23, the parameters are supplied to a computation module 33, in which the instantaneous actual status of the production process is determined. From the instantaneous actual status of the production process, an extrapolation is performed in the computation module 33 to obtain the actual value. The actual value is then supplied to a comparison module 34, in order that an actual/target evaluation can be performed. For this, the order-related target standard is supplied to the comparison module 34. The actual/target evaluation is used to obtain a differential value, which is supplied to an output unit 36. In this case, the output unit 36 may be combined with an ERP control unit or an operating unit.

FIG. 5 shows a further exemplary embodiment for a signal flow for monitoring and controlling a production order. The exemplary embodiment according to FIG. 5 is substantially identical to the exemplary embodiment according to FIG. 4, so that only the differences are indicated in the following.

In the case of the exemplary embodiment according to FIG. 5, the plant control unit 22 comprises a control module 32 and a computation module 35. From the product, machine and process parameters, the computation module 35 determines an actual status of the production process and supplies this to the planning control unit 23. The planning control unit 23 contains a computation module 33 and a comparison module 34, for obtaining a differential value from an actual/target evaluation. A planning module 37 is provided within the planning control unit 23.

The differential value is supplied to the planning module 37. The target standards of one or more production orders stored in the planning module 37 are compared in respect of the current differential value, by means of a given planning algorithm, and converted into a processing plan and forwarded. Thus, within an ERP control unit, a proposal can be directly converted into a processing plan, or individual proposals can also be adapted to existing sequences by modifying the target standards of the production orders. Particularly advantageously in this case, the standard for the primary products can be controlled at the same time. Thus, for example, the provision of primary products required in individual production orders could be effected via the processing plan. A high utilization of the machine capacity can be achieved in this way.

FIG. 6 shows, in schematic form, a further exemplary embodiment of a production process having an order control system according to the invention. In this case, the overall production process consists of a total of three sub-processes. In a first sub-process, a thermoplastic granulate is produced. The granulate production process is denoted by the reference 28. In a spinning process 29, a multiplicity of synthetic threads are spun from the previously produced granulate. In a third process, the so-called tire-cord production process 30, the threads are processed further, by cabling, to form a tire cord. Such tire-cord threads are required for the production of tires. Each of the sub-processes 28, 29 and 30 is monitored and controlled by a respective plant control unit 22.1, 22.2 and 22.3. The plant control units 22.1, 22.2 and 22.3 are connected in parallel, via the data connections 24.1, 24.2 and 24.3, to the planning control unit 23. The planning control unit 23 is coupled to an ERP control unit 26.

In the case of the exemplary embodiment represented in FIG. 6, the fiber product to be produced relates to a tire cord. In respect of the product quantity and the production time, there are three sub-processes to be taken into account in this case, the intermediate products of the first and second sub-processes being essential for the final product quantity of the fiber product. If, for example, it is found that, in the case of the first sub-process, problems arise which result in a defective quality of the required granulate, the whole process chain is shifted as a result, since, for example, only a granulate required with the quality level A is required for the spinning process. In order to record the effects and interaction of all sub-processes in relation to the production order, a target standard is entered in the planning control unit 23 in respect of each sub-process and the final fiber product. In this case, an actual/target evaluation can be performed in the planning control unit 23 in respect of each sub-process, so that the production order is first subdivided into individual sub-orders, to be completed in succession. From the actual/target evaluation for each sub-process, it is then possible to determine an effect on the overall production order, this being forwarded as a differential value. It is thereby possible to execute overlapping production orders.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A method for order control in a production process for a fiber product, said method comprising:

providing and further processing at least one primary product to form the fiber product;

performing individual processing steps of the further processing by machines;

determining the course of the production process by a target standard of a production order;

recording an actual status of the production process by determining a partial quantity of fiber product finished per unit of time;

performing an actual/target evaluation between a target standard predefined by the production order and the actual status of the production process to determine fulfillment or non-fulfillment of the production order in relation to the predefined target standard; and displaying a deviation from the target standard.

2. The method according to claim 1, wherein an order-related actual value relating to the fiber product is calculated from the partial quantity of fiber product and a differential value is produced from the actual/target evaluation, and wherein at least one of a product quantity or a production time for the production order is determined by the target standard.

3. The method according to claim 2, wherein the actual value is calculated from unit of time, the partial quantity of fiber product and the product quantity, and wherein an actual/target comparison results in a production time difference as a differential value.

4. The method according to claim 2, wherein the actual value is calculated from the partial quantity of fiber product, the unit of time and the production time, and wherein the actual/target comparison results in a product quantity difference as a differential value.

5. The method according to claim 1, wherein the order-related target standard is entered manually via at least one of an operating unit or an ERP (Enterprise Resource Planning) control unit.

6. The method according to claim 5, wherein a differential value is displayed by at least one of a display on the operating unit or a tracking system on the ERP control unit.

7. The method according to claim 6, wherein a counter-check is compiled between the target standard and the differential value in relation to a plurality of subsequent production orders, and a processing plan is derived from the counter-check.

8. The method according to claim 7, wherein in a case of non-fulfillment of the target standard, the target standard is modified, and a new processing plan is compiled from a renewed actual/target evaluation.

9. The method according to claim 1, wherein one or more status variables are recorded in relation to the fiber product or the machines executing the processing steps, and a partial quantity of fiber product is determined by means of the status variables.

10. The method according to claim 1, wherein a plurality of target standards of a plurality of production orders are defined, the target standards and the actual value are counter-checked according to a planning algorithm, and the provision of primary products for subsequent orders is initiated in dependence on the counter-checking.

11. The method according to claim 1, wherein the target standard is complemented by specifications relating to product properties and product qualities.

12. An apparatus for order control in a production process for a fiber product, said apparatus comprising:

a production plant for a fiber product produced from at least one primary product, consisting of a plurality of machines, and having a plant control unit which is connected to the machines via a control and monitoring network, wherein a master planning control unit is provided for determining fulfillment or non-fulfillment of the production order in relation to the predefined target standard by performing an actual/target evaluation between a target standard predefined by a production order and an actual status of the production process determined by a partial quantity of fiber product finished per unit of time, the planning control unit being coupled to the plant control unit via a data connection.

13. The apparatus according to claim 12, wherein the plant control unit has a means by which a partial quantity of fiber product finished per unit of time can be determined.

14. The apparatus according to claim 12, wherein the planning control unit has an interface for the connection of at least one of a manual operating unit or an ERP control unit, through which the target standard of the production order can be placed.

15. The apparatus according to claim 12, wherein the master planning control unit has a means for generating a differential value which results from the actual/target evaluation between the target standard predefined by the production order and the actual status of the production process.

16. The apparatus according to claim 12, wherein the master planning control unit has further means for determining a processing plan with specifications for the provision of the primary product and a time sequence for further processing.

17. The apparatus according to claim 12, wherein the planning control unit is connected to an output unit for visual display of data or processing plans.

18. The apparatus according to claim 17, wherein the output unit is combined with at least one of an operating unit or an ERP control unit.

* * * * *